US006539654B2

(12) United States Patent
Lin

(10) Patent No.: US 6,539,654 B2
(45) Date of Patent: Apr. 1, 2003

(54) BUBBLE-TYPE MULTICOLOR-LIQUID LAMP

(76) Inventor: Ming-Kuei Lin, 17F, No. 309, Sec. 2, Wen Hua Rd., Panchiao, Taipei Hsien (TW)

( * ) Notice: Subject to any disclaimer, the term of this patent is extended or adjusted under 35 U.S.C. 154(b) by 0 days.

(21) Appl. No.: 09/884,023

(22) Filed: Jun. 20, 2001

(65) Prior Publication Data

US 2002/0194757 A1 Dec. 26, 2002

(51) Int. Cl.[7] ..... G09F 19/00
(52) U.S. Cl. ..... 40/406; 40/439
(58) Field of Search ..... 40/406, 409, 439, 40/477; 446/267

(56) References Cited

U.S. PATENT DOCUMENTS 3,499,238 A * 3/1970 Publicker ..... 40/406
3,964,194 A * 6/1976 Gugeler ..... 220/246
4,974,127 A * 11/1990 Foley ..... 362/101
5,106,660 A * 4/1992 Vorel ..... 40/406
5,349,771 A * 9/1994 Burnett ..... 285/140.1
5,706,594 A * 1/1998 Lin ..... 40/406
6,070,348 A * 6/2000 Bianchetti ..... 40/406
6,153,273 A * 11/2000 Lee Lin ..... 40/406
6,187,394 B1 * 2/2001 Johnson et al. ..... 119/245

* cited by examiner

*Primary Examiner*—William L. Miller
(74) *Attorney, Agent, or Firm*—Dennison, Schultz & Dougherty

(57) ABSTRACT

A lamp includes a main body mounted on a base and formed from multiple layers of transparent wall panels that are spaced from one another by a small distance so that a narrow chamber is provided between any two adjacent layers of wall panels. Each of the narrow chambers contains a colored liquid and is provided at a bottom with an air supply port to communicate with air pumping equipment. When the pumping equipment is actuated, air bubbles are continuously produced to enter the narrow chambers, where the bubbles are flattened into irregular and clear shapes enclosed by differently colored liquids while moving upward in the narrow chambers. A light-emitting diode mounted at a bottom of the main body projects light beams to shine on the irregular floating bubbles and the color liquids in the multiple layers of narrow chambers, creating dynamic, changing and colorful views on the lamp.

6 Claims, 10 Drawing Sheets

BUBBLE-TYPE MULTICOLOR-LIQUID LAMP

BACKGROUND OF THE INVENTION

The present invention relates to a bubble-type multicolor-liquid lamp, and more particularly to a lamp that has a main body formed from multiple layers of transparent wall panels, between which narrow chambers are formed to contain color liquids and communicate with air pumps. When the lamp is turned on, the air pumps continuously produce bubbles that enter the narrow chambers and are flattened into irregular shapes enclosed by the color liquids while moving upward in the narrow chambers, creating dynamic, changeful and colorful views on the lamp.

There are many different designed liquid ornaments available in the markets. One of these liquid ornaments is a rotational color-liquid decoration disclosed in U.S. Pat. No. 5,706,594 granted to the applicant of the present application. The rotational color-liquid decoration of U.S. Pat. No. 5,706,594 includes a decoration having multiple layers or narrow chambers in which differently colored liquids are contained. A driving means is employed to drive the liquids to flow through the narrow chamber, to produce a plurality of flattened, irregularly shaped and overlapped overlapping color areas that move in the narrow chambers to create dynamic and changeful views. A disadvantage of the rotational color-liquid decoration of U.S. Pat. No. 5,706,594 is the somewhat complicate driving means. Moreover, the decoration containing the color liquids must always be kept in a rotating state.

SUMMARY OF THE INVENTION

A primary object of the present invention is to provide a bubble-type multicolor-liquid lamp on which dynamic, changeful and colorful views are created while the lamp stands still.

Another object of the present invention is to provide a bubble-type multicolor-liquid lamp that has a main body for showing dynamic, changeful, and colorful views, and the main body may be of any shape.

To achieve the above and other objects, the bubble-type multicolor-liquid lamp of the present invention mainly includes a main body of any shape mounted on a base and formed from multiple layers of transparent wall panels that are spaced from one another by a small distance so that a narrow chamber is provided between any two adjacent layers of wall panels. Each of the narrow chambers contains a colored liquid and is provided at a bottom with an air supply port to communicate with air pumping equipment. When the pumping equipment is actuated, air bubbles are continuously produced to enter the narrow chambers, where the bubbles are flattened into irregular and clear shapes enclosed by different colored liquids while keep moving upward in the narrow chambers. A light-emitting device mounted at a bottom of the main body projects light beams to shine on the irregular and floating bubbles and the colored liquids in the multiple layers of narrow chambers, creating dynamic, changeful and colorful views on the lamp.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
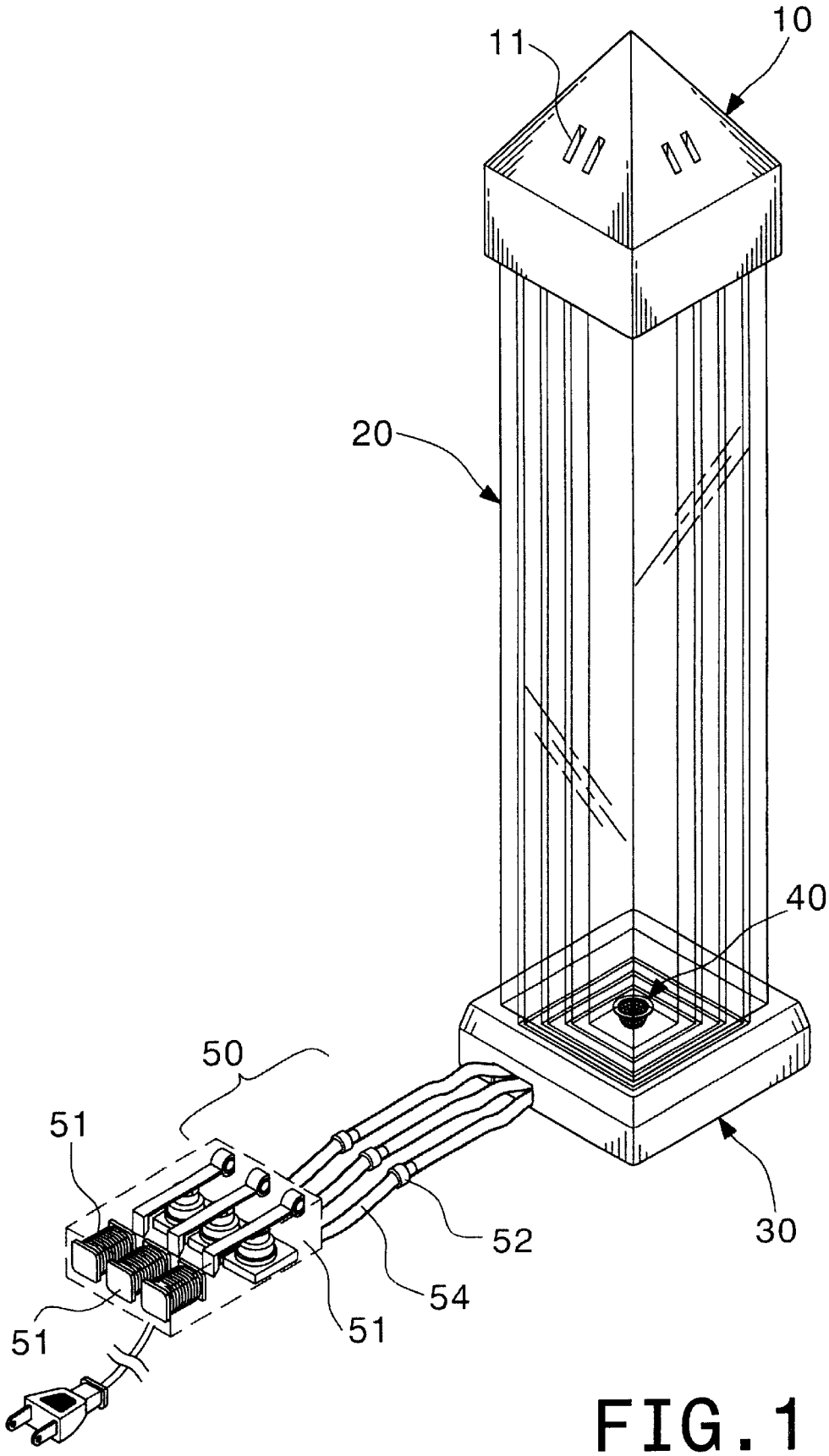
FIG. 1 is a perspective view of a bubble-type multicolor-liquid lamp according to a first embodiment of the present invention.

Please refer to FIGS. 1, 2, 3 and 4 in which a bubble-type multicolor-liquid lamp according to a first embodiment of the present invention is shown. For the purpose of clarity, the bubble-type multicolor-liquid lamp will be referred to as "the lamp" hereinafter. As shown, the lamp of the present invention mainly includes a top cover 10, a main body 20, a base 30, a light-emitting device 40, and an air pumping equipment 50.

The main body 20 is seated on the base 30 and may be of any shape. In the illustrated first embodiment of the lamp, the main body 20 is a square column defining a hollow chamber 21 therein. The light-emitting device 40 is mounted at a bottom of the hollow chamber 21 to upward project light beams. The main body 20 includes a wall portion 22 that is formed from multiple layers of walls in the form of transparent thin panels 221 spaced from one another by a predetermined distance, such that a narrow chamber 222 is formed between any two adjacent thin walls 221. It is not suitable to have too many layers of thin walls 221. A wall portion 22 having three or four layers of thin walls 221 is preferable. The squared column of the main body 20 shown in FIGS. 2 to 4 includes four layers of thin walls 221 to provide three layers of narrow chambers 222. Different colored liquids, for example, red, blue and green liquids, are separately contained in the narrow chambers 222. All layers of the thin wall 221 may be provided at desired positions with projected ribs 223, so that each narrow chamber 222 is further divided into several show areas 224. In FIG. 3, each inner thin wall 221 is provided at four corners with outward projected ribs 223 to divide four sides of the squared column 20 into four show areas 224. It is not necessary for the dhow areas 224 to be completely isolated from one another by the ribs 223. That is, it is also possible for a clearance 223' (FIG. 3) to exist between two adjacent show areas 224, so that colored liquids or air inside respective show areas 224 are communicable with one another. The projected ribs 223 also serve as spacers between two adjacent layers of transparent thin walls 221, so that multiple layers of inner walls 221 could be easily nested inside the outermost layer of wall 221.

Figure 2:
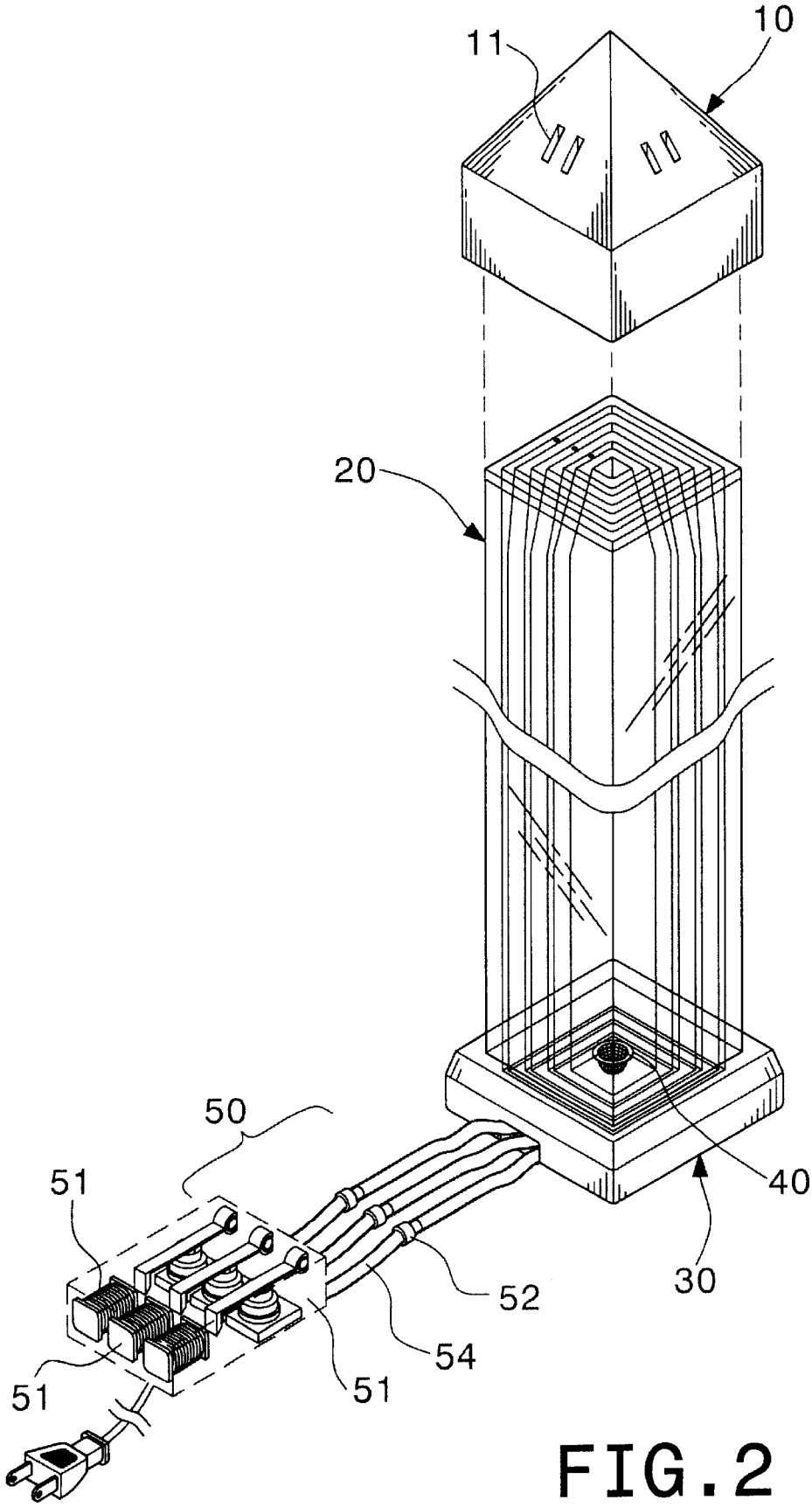
FIG. 2 is similar to FIG. 1 with a top cover of the lamp removed therefrom to show an upper structure of the lamp.
Figure 3:
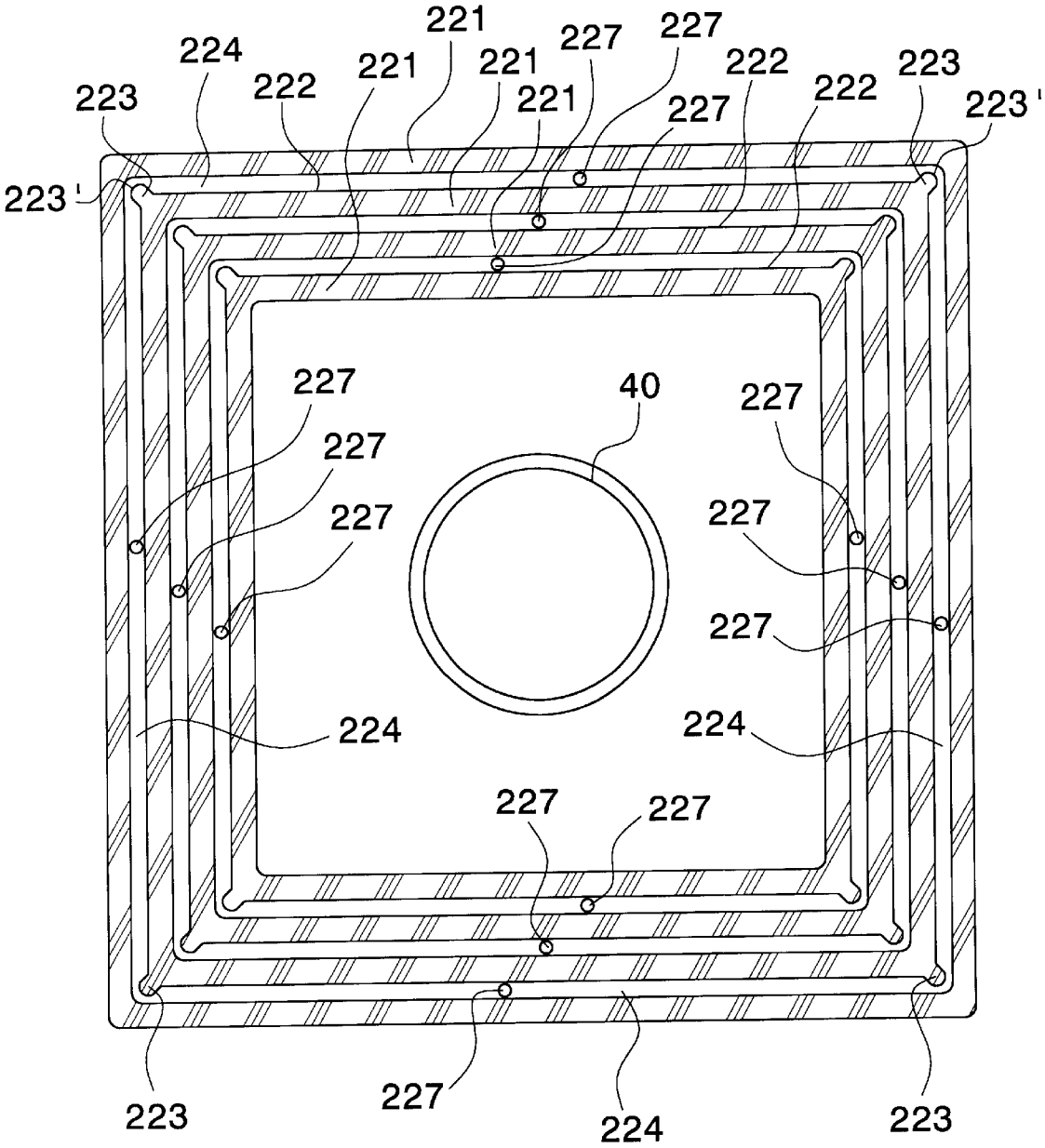
FIG. 3 is a cross sectional view of a main body of the lamp of FIG. 1.
Figure 4:
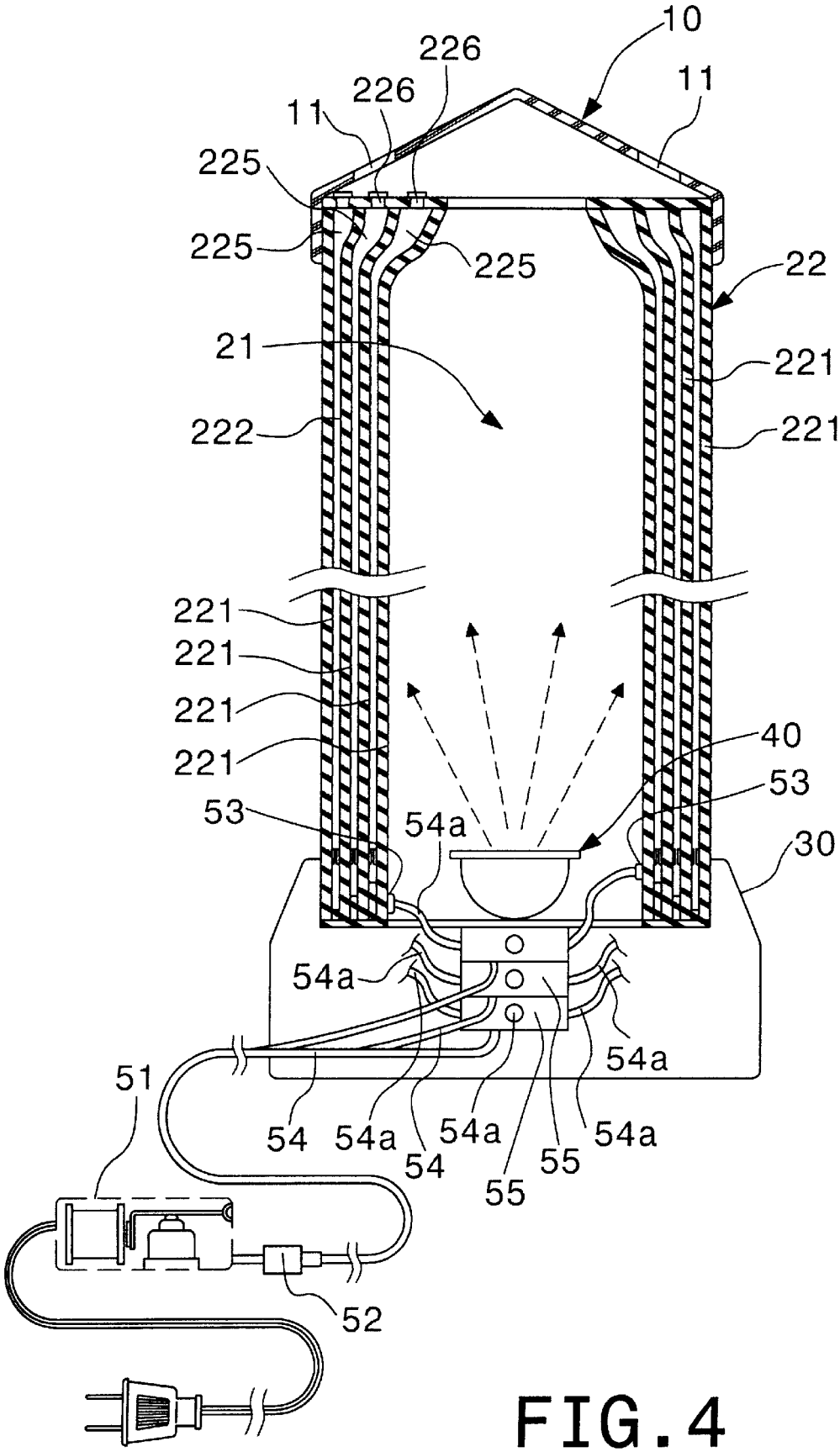
FIG. 4 is a vertical sectional view of the lamp of FIG. 1.

Please particularly refer to FIGS. 2 and 4. The inner layers of thin walls 221 have upper portions that incline inward such that expanded air-collecting zones 225 are separately formed at upper parts of the narrow chambers 222. Air relief valves 226 are separately provided on top of the air-collecting zones 225 for releasing air inside the narrow chambers 222 and preventing colored liquids from flowing out when the lamp is unexpectedly tilted. The top cover 10 decorates the top of the main body 20 and is provided with slots 11 to radiate heat or release hot air from the main body 20.

Each show area 224 is provided at a bottom center with an air supply port 227 that is communicably connected to the air pumping equipment 50. When the air pumping equipment 50 is actuated, air is continuously supplied into the main body 20 via the air supply ports 227 to produce air bubbles that enter the narrow chambers 222.

Figure 7:
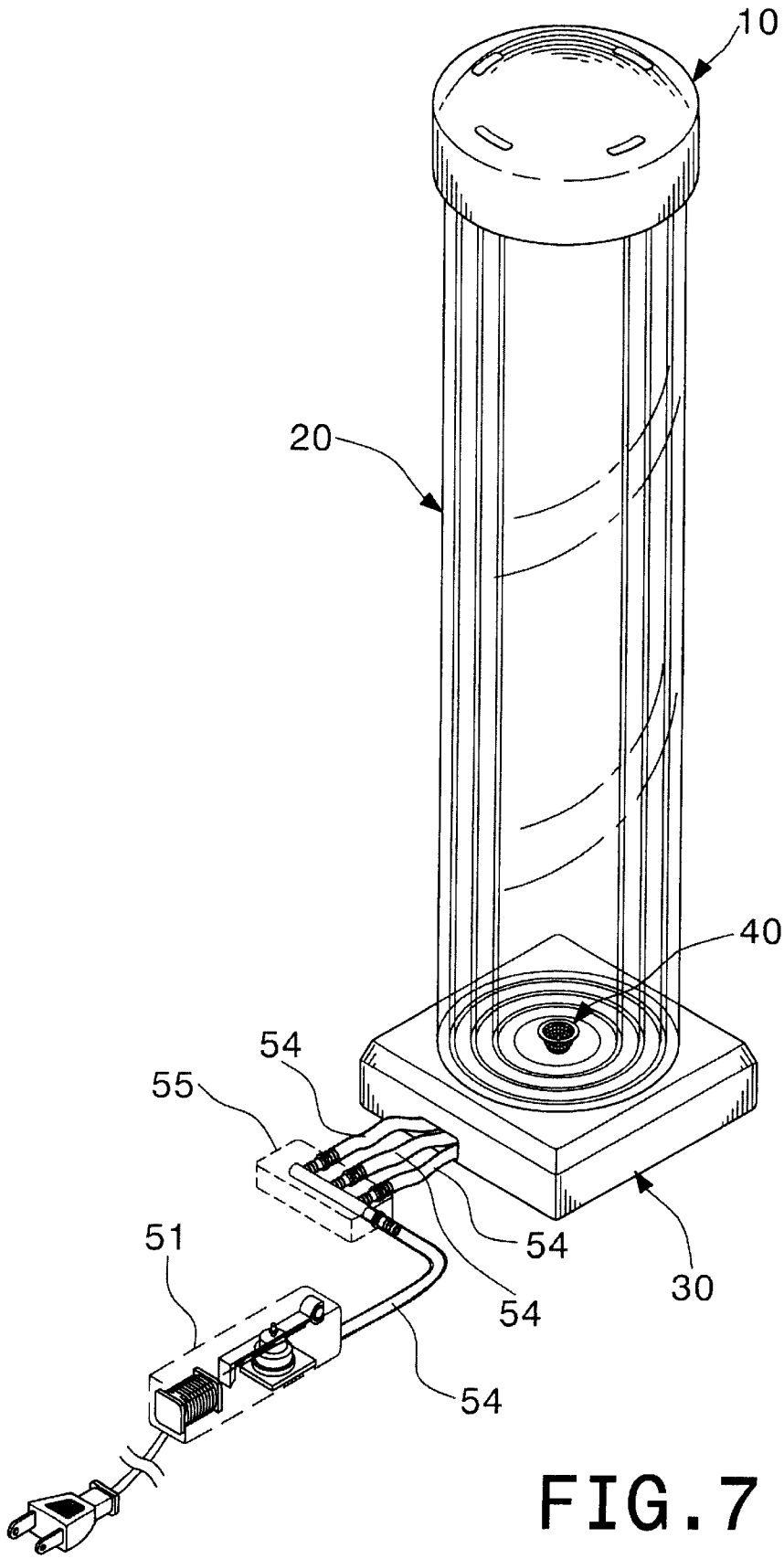
FIG. 7 is a perspective view of a bubble-type multicolor-liquid lamp according to a second embodiment of the present invention.

The air pumping equipment 50 is known in the art. In the present invention, the air pumping equipment 50 includes one or more pumps 51, water check valves 52, sealing plugs 53, air ducts 54 and/or shunts 55 that all are known in the art. Pumps 51 of different specifications may be selected for different narrow chambers 222. For example, three pumps 51 are provided to correspond to three narrow chambers 222, as shown in FIGS. 1 and 2. Each pump 51 is connected to one air duct 54 and one water check valve 52 and led to a lower portion of the main body 20. Alternatively, only one pump 51 is provided, as shown in FIG. 7. In this case, the pump 51 is first connected to a shunt 55, at where the air duct 54 is divided into three ducts 54.

There is no specific limitation to a piping connection from the pumps 51 to the air supply ports 227. Different designs may adopted depending on assembling manner and available material and cost. FIG. 4 shows three air ducts 54 are extended into the base 30 and then connected to three four-way shunts 55, so that each air duct 54 is further divided into four branch pipes 54*a* for separately connecting to four air supply ports 227. Thus, there are total 12 branch pipes 54*a* connected to 12 air supply ports 227 in the piping connection shown in FIG. 4.

Figure 5:
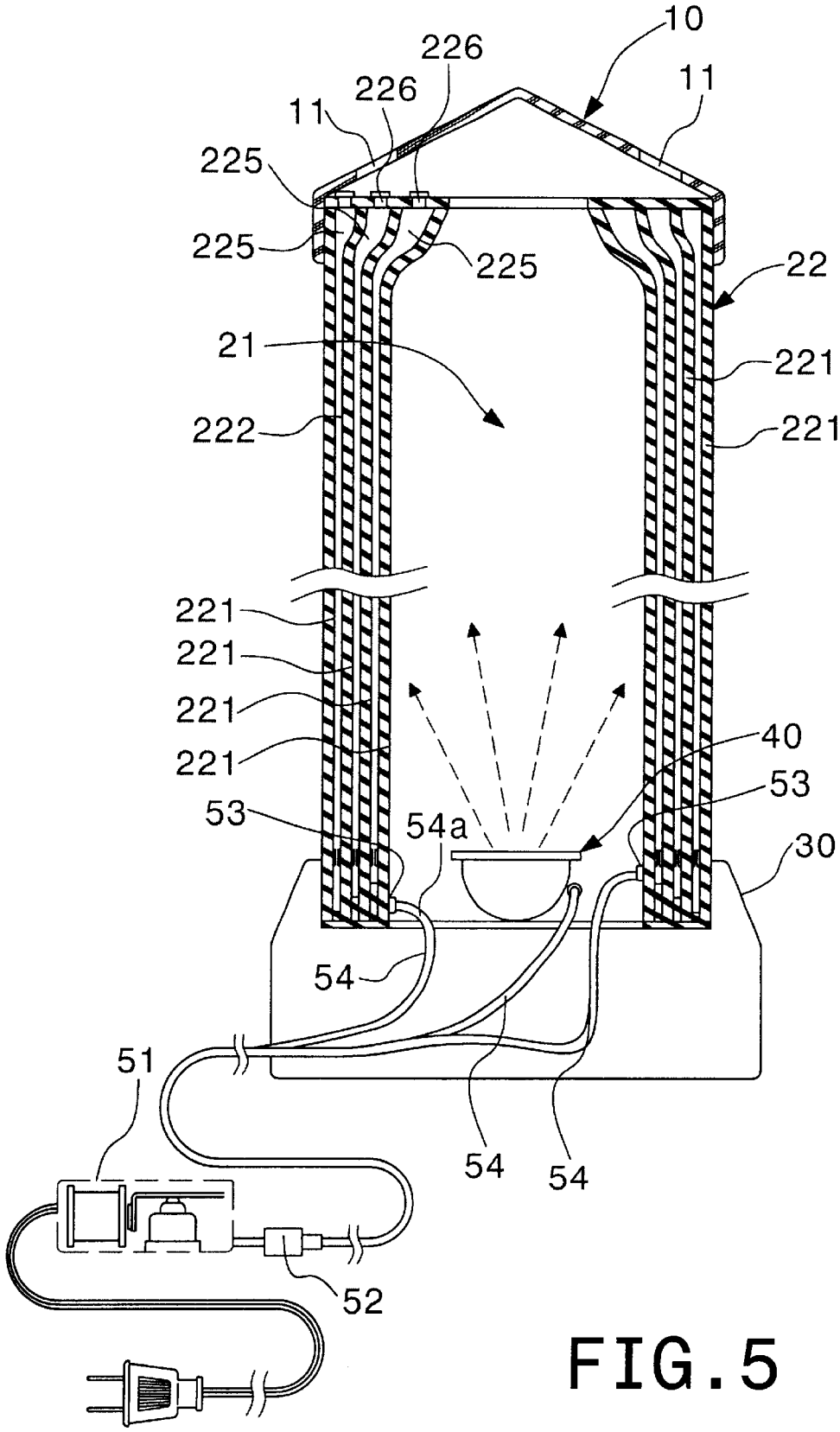
FIG. 5 is similar to FIG. 4 except that a different air duct system for the lamp is shown.
Figure 6:
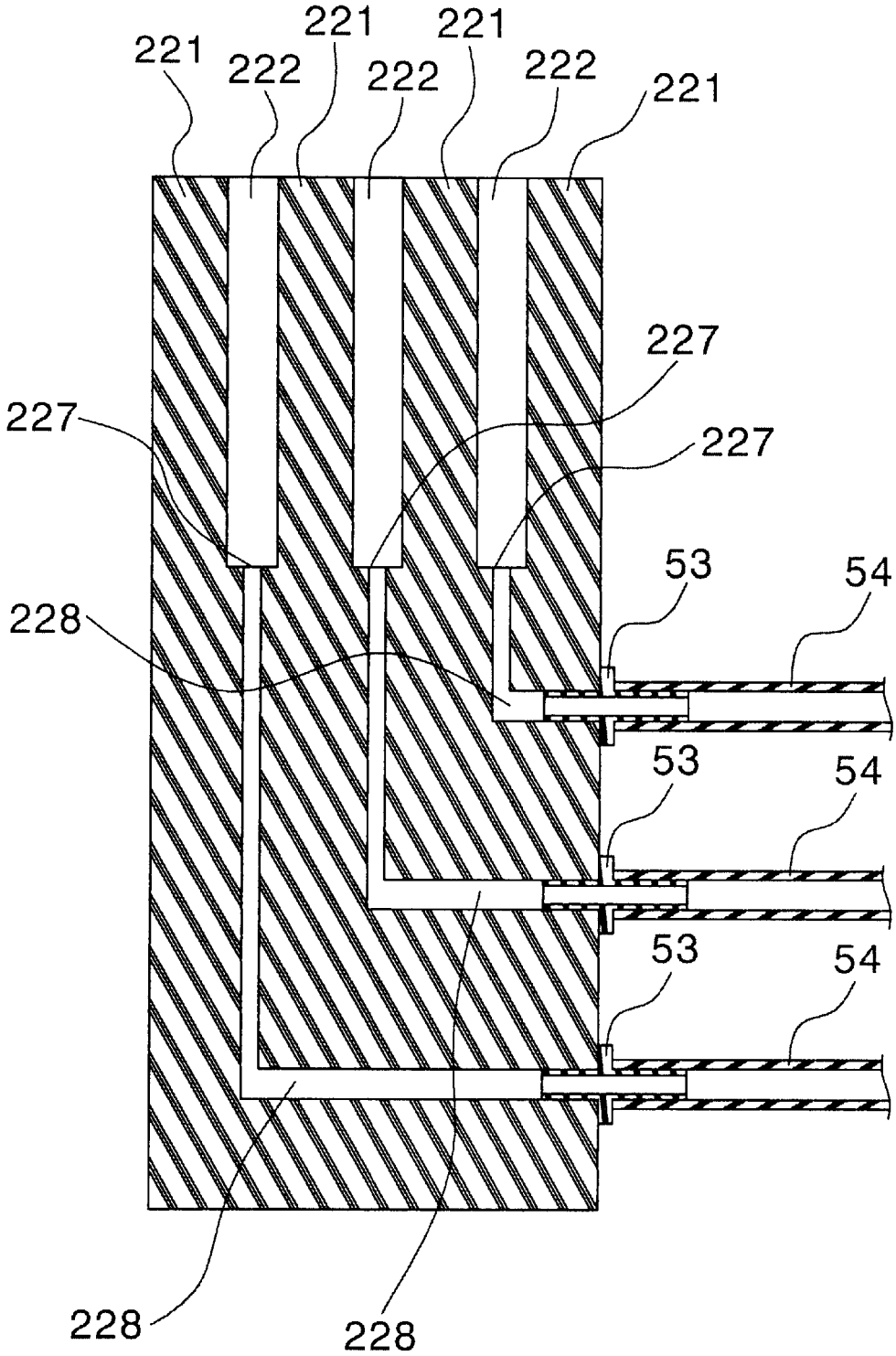
FIG. 6 is a fragmentary and enlarged view showing air supply ports of the lamp of FIG. 5.

FIGS. 5 and 6 illustrate another piping connection that could be adopted in the present invention. In this piping connection, a communicating pipe 228 is connected to the four air supply ports 227 of each narrow chamber 222, so that total three separate communicating pipes 228 are provided for three narrow chambers 222. Three air ducts 54 are extended into the base 30 to each connect to one of the three communicating pipes 228 and accordingly four of the 12 air supply ports 227. In this manner, the three four-way shunts 55 and the 12 branch pipes 54*a* could be omitted.

The light-emitting device 40, the pumps 51 and the shunts 55 could be located inside or outside the base 30.

To use the lamp of the present invention, first connect it to an external power source to actuate the light-emitting device 40 and the one or more pumps 51. At this point, air bubbles are continuously produced at the air supply ports 227 located at the bottom of the show areas 224. The air bubbles enter into the narrow chambers 222 and are flattened into irregular shapes that have increased areas than normal air bubbles. The flattened bubbles are transparent and enclosed by colored liquid. With the flattened and irregularly shaped bubbles that keep moving upward in the color-liquid containing show areas 224 of the narrow chambers 222, dynamic, changeful, and multicolored views are displayed on four sides of the lamp of the present invention. Light beams projected from the light-emitting device 40 toward the wail portion 22 of the lamp further enhance a decorative function of the lamp.

The ribs 223 among the show areas 224 allow the bubbles in different show areas 224 to float without interfering with one another and therefore provide even better visual effect.

Figure 8:
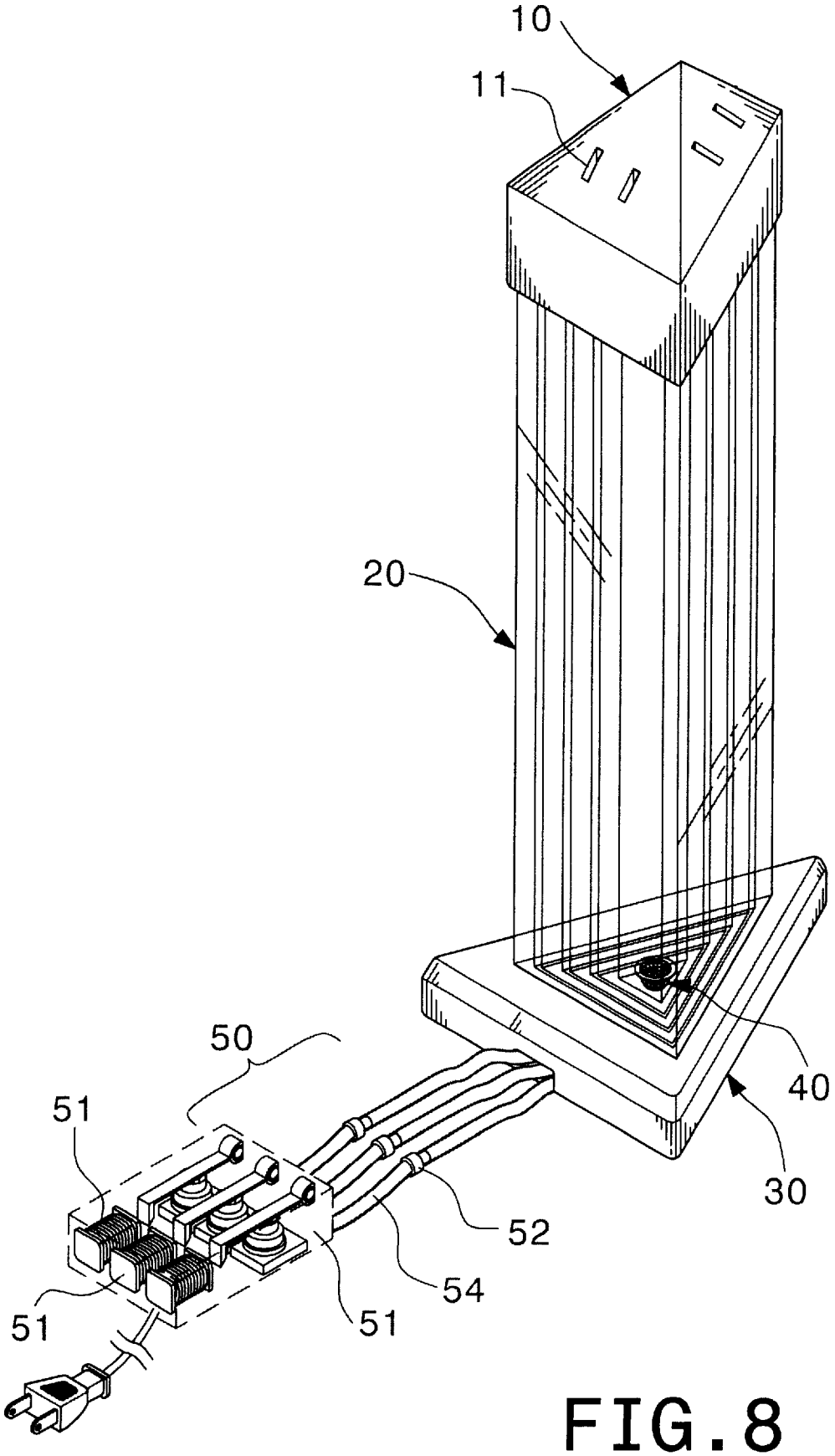
FIG. 8 is a perspective view of a bubble-type multicolor-liquid lamp according to a third embodiment of the present invention.
Figure 9:
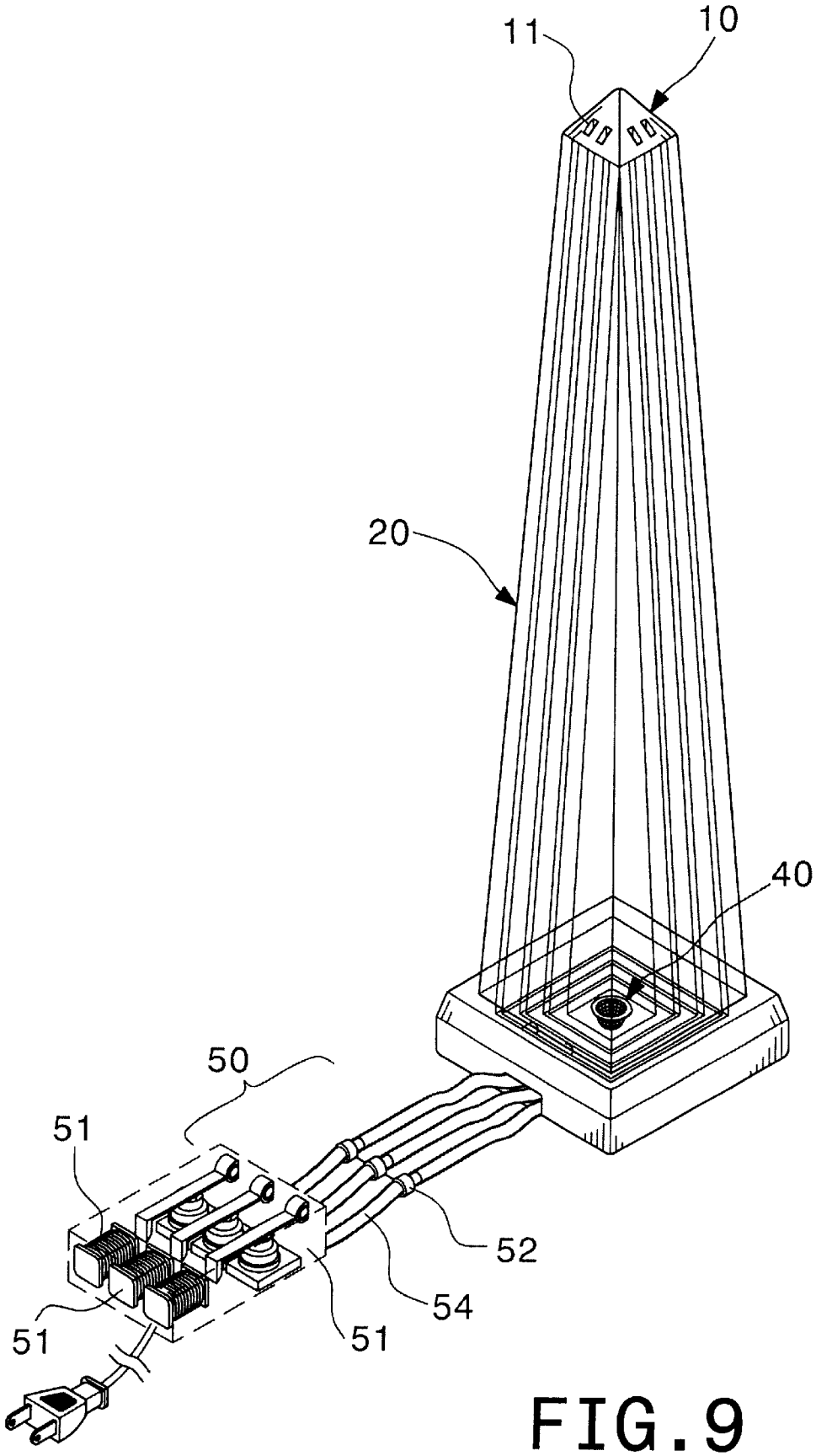
FIG. 9 is a perspective view of a bubble-type multicolor-liquid lamp according to a fourth embodiment of the present invention.
Figure 10:
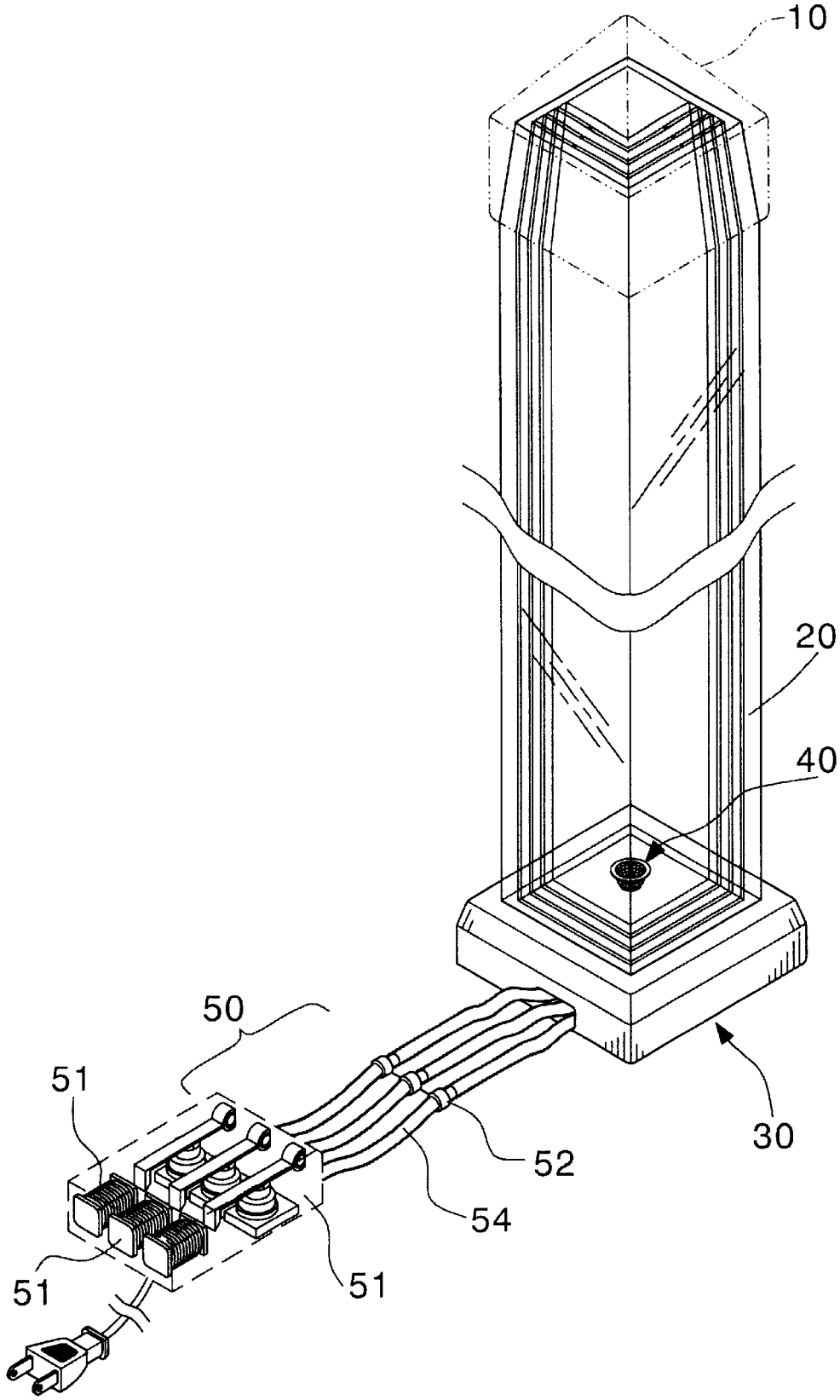
FIG. 10 is a perspective view of a bubble-type multicolor-liquid lamp according to a fifth embodiment of the present invention.

As mentioned above, the main body 20 maybe of any shape. In addition to the squared column as shown in FIG. 1, the main body 20 may also be a round column as shown in FIG. 7, a triangular column as shown in FIG. 8, or a pyramid as shown in FIG. 9. FIG. 10 shows a variant of the lamp of FIG. 1. In this variant, only two of the four sides of the squared column 20 are designed in the above-described manner to display dynamic, changeful and colorful views on the lamp. The top cover 10 and the base 30 may be differently designed to match with the shape of the main body 20 while other structure of the lamp could maintain unchanged.

What is claimed is:

1. A multicolor-liquid lamp comprising a top cover, a main body, a base, a light-emitting device, and air pumping equipment;

said main body being seated on said base and defining a hollow chamber, said main body including a wall portion formed from multiple layers of transparent thin wall panels spaced from one another by a predetermined distance, such that a narrow chamber is formed between any two of said transparent thin wall panels adjacent to each other;

and different colored liquids contained in said narrow chambers and said narrow chambers being divided by projecting ribs on said transparent thin wall panels into a plurality of show areas;

each of said show areas being provided at a bottom center with an air supply port communicable with said air pumping equipment;

said top cover being mounted on a top of said main body and provided with slots for radiating heat from said lamp;

said base supporting said main body and defining an inner space for mounting said air pumping equipment and other related components;

said light-emitting device being mounted at a bottom of said hollow chamber of said main body to upward project light beams towards said wall portion of said main body;

said air pumping equipment including one or more air pumps, water check valves, sealing plugs, air ducts and shunts, such that air bubbles are continuously produced by said air pumping equipment and supplied to said narrow chambers of said main body via said air ducts, said shunts and said air supply ports; and said air bubbles continuously produced by said air pumping equipment entering said narrow chambers and being flattened into expanded and irregular transparent shapes enclosed by said colored liquids while moving upwardly in said narrow chambers, said flattened and floating bubbles together with said colored liquids in said narrow chambers and said light beams projected from said light-emitting device creating dynamic, changeful, and colorful views on said wall portions of said lamp; and, wherein said show areas of each said narrow chamber are communicable with one another via clearances existing between said projected ribs and said thin wall panels opposite to said ribs.

2. The multicolor-liquid lamp as claimed in claim 1, wherein said main body is in the shape of a square column.

3. The multicolor-liquid lamp as claimed in claim 2, wherein said square column of said main body is provided at all four sides with said narrow chambers and said show areas.

4. The multicolor-liquid lamp as claimed in claim 2, wherein said square column of said main body is provided at only two of four sides with said narrow chambers and said show areas.

5. The multicolor-liquid lamp as claimed in claim 1, wherein said main body is in the shape of a triangular column.

6. The multicolor-liquid lamp as claimed in claim 1, wherein said main body is in the shape of a pyramid.

* * * * *